United States Patent [19]

Sluys

[11] 4,342,276

[45] Aug. 3, 1982

[54] INTERCONNECTING SYSTEM FOR MARINE FLOATS

[75] Inventor: Wesley W. Sluys, Bellingham, Wash.

[73] Assignee: Builders Concrete, Inc., Bellingham, Wash.

[21] Appl. No.: 164,915

[22] Filed: Jun. 30, 1980

[51] Int. Cl.[3] ..... B63B 35/44

[52] U.S. Cl. ..... 114/266; 405/219

[58] Field of Search ..... 114/263, 266, 267; 405/218, 219, 220, 221

[56] References Cited

U.S. PATENT DOCUMENTS

| | | | |
|---|---|---|---|
| 3,091,203 | 5/1963 | Usab | 114/266 |
| 3,191,564 | 6/1965 | Filak | 114/266 |
| 3,799,093 | 3/1974 | Thomson | 114/266 |
| 3,977,344 | 8/1976 | Holford | 114/263 |
| 4,097,948 | 7/1978 | Finsterwalder | 114/263 X |
| 4,252,470 | 2/1981 | Sluys | 114/263 |
| 4,263,865 | 4/1981 | Shorter | 114/266 X |

*Primary Examiner*—Sherman D. Basinger
*Attorney, Agent, or Firm*—Seed, Berry, Vernon & Baynham

[57] ABSTRACT

A pair of marine floats are interconnected end-to-end by a pair of tubular conduits embedded in the floats along opposite sides thereof. The conduits extend from one float to the other and their ends are connected to respective junction boxes embedded in the floats. The conduits pass through respective resilient cushions positioned between the floats to allow the floats to pivot with respect to each other. The tension in the conduits increases as the floats pivot, and this increase in tension is compensated for by resiliently securing the conduits to the junction boxes so that the conduits can move axially with respect to the junction boxes. The junction boxes may be secured to reinforcing bars embedded in the floats, particularly where a conduit extends from only one side of the junction box. Conventional utility conductors are routed through the conduits which may be connected to utility outlets mounted on the junction boxes. The conduit may be surrounded by a reinforcing sleeve as it extends between floats to protect the conduit from excessive shear forces. The conduits may also be used to pivotally interconnect floats by mounting a transversely positioned tube between the ends of the conduits projecting from an end wall of a float and positioning the tube within a larger tube which is mounted on the sidewall of a second float.

8 Claims, 9 Drawing Figures

INTERCONNECTING SYSTEM FOR MARINE FLOATS

BACKGROUND OF THE INVENTION

1. Field of the Invention

This invention relates to marine floats of the type used to construct floating moorage facilities, and more particularly, to a system for providing both mechanical and utility interconnections between such floats.

2. Description of the Prior Art

Marine floats having a buoyant foam core surrounded by a concrete casing are commonly used to construct floating moorage facilities. Such floats are typically interconnected end-to-end to form a mainwalk. A large number of usually smaller "finger floats" project perpendicularly from the mainwalk, and individual boats are moored to these finger floats.

A variety of techniques have been used to mechanically interconnect the floats with sufficient strength to withstand wave and tidal action yet allow some relative movement between floats. One commonly used technique involves placing elongated wales along the upper side edges of the floats in a manner which bridges the gap between adjacent floats. The wales are typically secured to the float by tie-rods extending transversely through the float and projecting through the wales.

Another common technique for mechanically interconnecting marine floats is the use of post-tensioned tendons. In accordance with this approach, pairs of highly tensioned cables extend longitudinally through the floats, with the ends of the cables being anchored to the end floats.

The above-described mechanical interconnecting structures, among others, have been successfully used for many years. However, the mechanical interconnections are complicated by the need, in most cases, to provide utility service to vessels moored at the finger floats. Consequently, a utility interconnecting system is normally employed which is entirely separate from the mechanical interconnecting system. Commonly used utility interconnecting systems include utility troughs extending longitudinally through the floats which are covered by removable panels, utility conduits mounted beneath the wales extending along the sidewalls of the floats or by running utility conduits longitudinally on the upper surface of the float. While such techniques are satisfactory, the use of a mechanical interconnecting structure which is separate and apart from the utility interconnecting structure unduly increases the capital cost and installation expense of such moorage facilities.

SUMMARY OF THE INVENTION

It is an object of the invention to provide a single structure for providing both mechanical and utility interconnections between marine floats.

It is another object of the invention to provide a combined mechanical and utility interconnecting system which facilitates the routing of utility conductors to utility outlets.

It is still another object of the invention to provide a combined mechanical and utility interconnecting system which allows marine floats to be pivotally connected to each other.

It is a further object of the invention to provide a combined mechanical and utility interconnecting system which permits some degree of relative movement between adjoining floats.

These and other objects of the invention are provided by a pair of tubular conduits extending longitudinally along opposite sides of a pair of floats which are positioned end-to-end. The ends of the conduits are resiliently fastened to respective anchoring members embedded in the floats. The conduits pass through resilient cushions positioned between the ends of adjoining floats to allow the floats to pivot with respect to each other. The pivotal movement increases the tension of the conduits, but this tension is compensated for by the resilient fastening means which permit the conduits to move axially and pivot with respect to the anchoring members. The anchoring means is preferably a hollow junction box which receives utility conductors extending through the conduits and facilitates connection of the utility conductors to conventional utility outlets mounted on the junction boxes. The portion of the conduit bridging the floats may be protected against excessive shear forces by a reinforcing sleeve which surrounds the conduit between the floats. Elongated wales may extend along the sides of the floats to cushion the impact of vessels against the floats. In the event that the wales interconnect adjoining floats, they are preferably positioned in the same vertical plane as the conduits, thereby minimizing the axial forces imparted to the wales responsive to pivotal movement of the floats with respect to each other. The floats may be pivotally interconnected to each other by securing a sleeve transversely along the end wall of a float between a pair of the conduits projecting from the end wall. A second sleeve, having a length shorter than the distance between the conduits and an inside diameter larger than the outside diameter of the first sleeve, is secured to another float, with the first sleeve extending through the second sleeve.

DETAILED DESCRIPTION OF THE INVENTION

Figure 1:
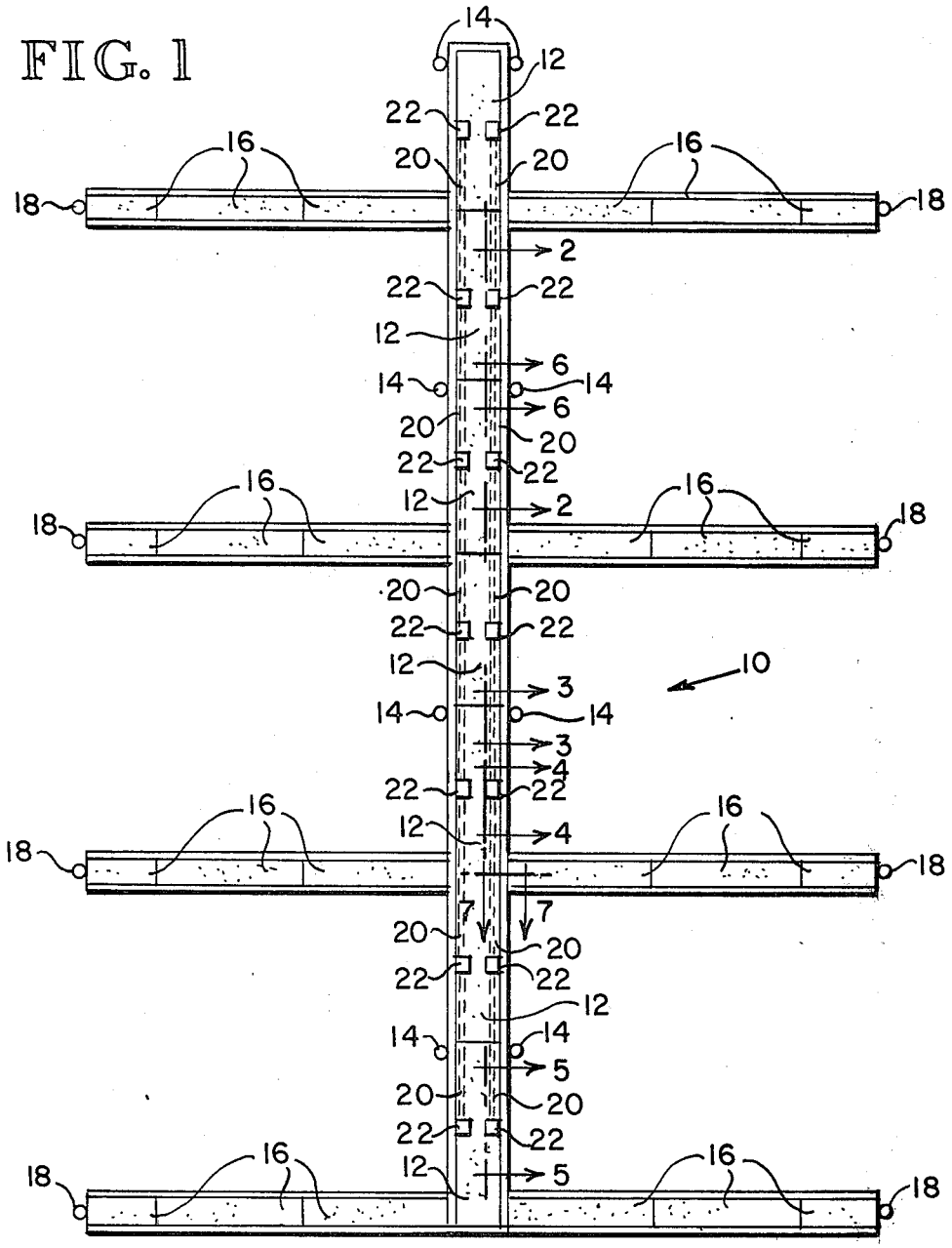
FIG. 1 is a top plan view of a large number of marine floats joined together with the inventive interconnecting system to form a floating moorage facility.

A floating moorage facility of the type utilizing the inventive interconnection system is illustrated in FIG. 1. The facility includes a mainwalk 10 formed by a row of mainwalk floats 12 arranged end-to-end between pairs of spaced-apart piles 14 which fix the transverse position of the mainwalk 10. Several finger floats 16, secured end-to-end, project perpendicularly from the mainwalk 10 at spaced-apart points. The transverse positions of the finger floats 16 are fixed by the connection between the finger floats 16 and the main walk 10 and by a pile 18 to which the end finger float 16 is slidably connected.

In accordance with the inventive interconnecting system, a plurality of conduits 20 extend longitudinally along opposite sides of the mainwalk floats 12. The ends of the conduits 20 are connected to respective junction boxes 22 which are embedded in the mainwalk floats 12. As explained in greater detail hereinafter, conventional utility outlets (not shown) may be mounted on the junction boxes 22 to facilitate the coupling of utility conductors extending through the conduit 20 to the utility outlets. The conduits 20 thus provide both mechanical and utility interconnections between mainwalk floats 12.

Figure 2:
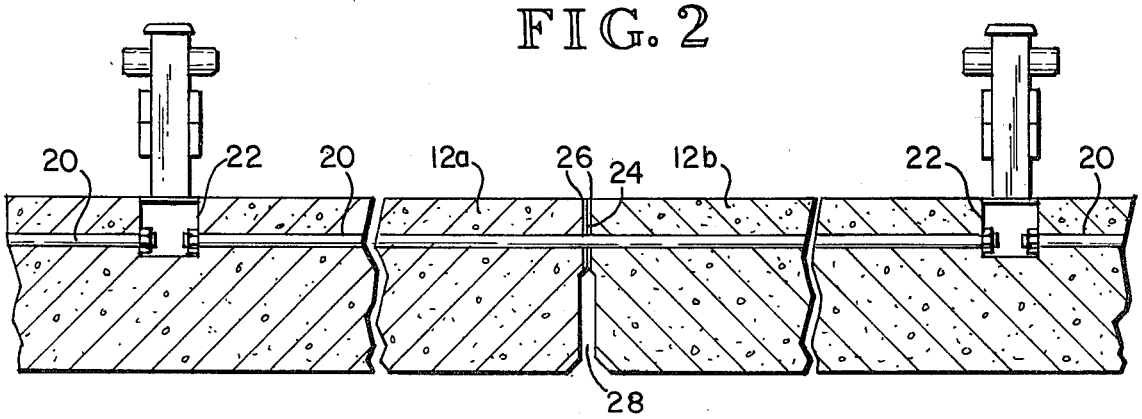
FIG. 2 is a cross-sectional view taken along the line 2—2 of FIG. 1.
Figure 3:
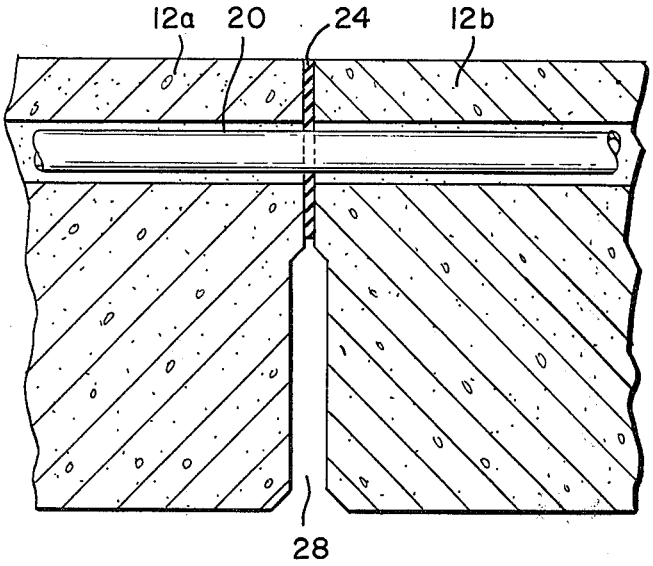
FIG. 3 is a cross-sectional view taken along the line 3—3 of FIG. 1 showing the junction between adjoining floats.

The internal structure of the interconnecting system is illustrated in greater detail in FIG. 2. The conduit 20, extending from one mainwalk float 12*a* to the other 12*b*, passes through a resilient cushion 24 positioned between the abutting end walls of the floats 12*a,b*, as illustrated in greater detail in FIG. 3. It will be noted that the upper end wall of the floats 12*a,b* has formed therein an outwardly projecting flange 26, thereby providing a clearance zone 28 across the lower end walls of the floats 12*a,b*. This structure, coupled with the use of the resilient cushion 24, allows the floats 12*a,b* to pivot with respect to each other to some degree responsive to wave and tidal action. Securing the floats 12*a,b* to each other more rigidly would require substantially greater strengthh as compared to an interconnecting structure allowing some degree of movement. It will be recognized, however, that pivotal movement of the floats 12*a,b* with respect to each other increases the spacing between the floats 12*a,b*, thereby increasing the tension of the conduit 20. Since the material used for the conduits 20 may not be sufficiently resilient, a structure must be provided for allowing axial movement of the conduits 20 with respect to the float 12 to which they are connected via the respective junction boxes 22.

Figure 4:
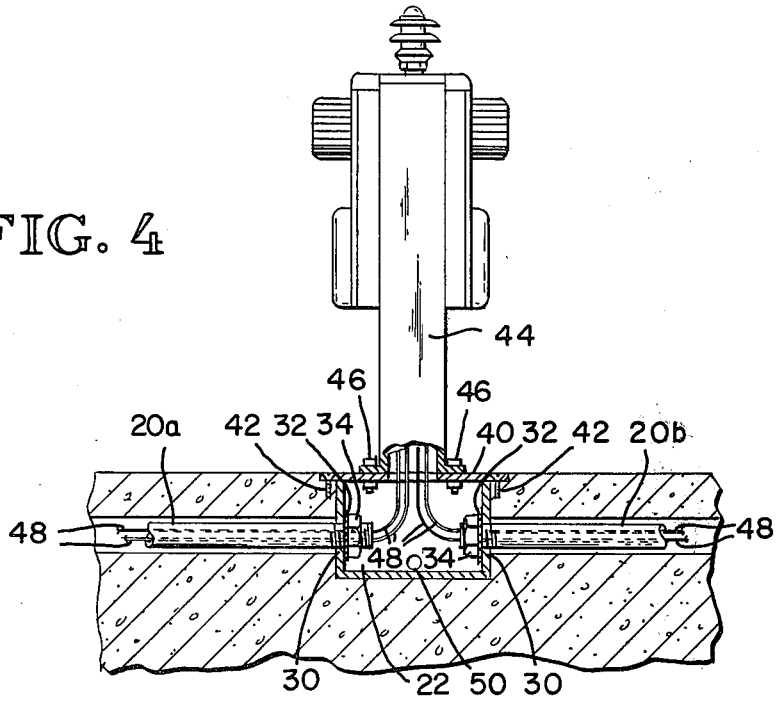
FIG. 4 is a cross-sectional view taken along the line 4—4 of FIG. 1 showing the manner in which the conduits are secured to an embedded junction box.

Accordingly, as illustrated in FIG. 4, the ends of the conduits 20*a,b* project through apertures (not shown) formed in end walls 30 of the junction box 22 and through resilient pads 32. Respective nuts 34 are threaded onto the ends of the conduits 20*a,b* and are torqued against the end wall 30, thereby compressing the respective pads 32. Consequently, tensioning of the conduits 20*a,b* further compresses the resilient pads 32, thereby allowing the conduits 20*a,b* to move axially with respect to the junction box 22 as the floats 12*a,b* pivot with respect to each other. The resilient pads 32 also allow the conduits 20*a,b* to pivot to some extent with respect to the junction box 22 as the floats 12*a,b* pivot.

As also illustrated in FIG. 4, a removable cover 40 releasably secured to threaded inserts 42 covers the junction box 22. As mentioned above, a conventional utility outlet 44 is mounted on the cover 40 by bolts 46. Utility conductors 48, such as electricity, telephone, water and the like, are routed through the conduits 20*a,b* and upwardly into the utility outlet 44. A drain hole 50 in the junction box 22 allows the escape of any water entering the junction box 22. It is thus seen that the junction box 22 not only interconnects the conduits 20*a,b*, but it also facilitates the routing of utility conductors 48 to conventional utility outlets 44. Furthermore, it does so in a manner which compensates for variations in the tension of the conduits 20*a,b* responsive to relative pivotal movement between the floats 12*a,b*.

Figure 5:
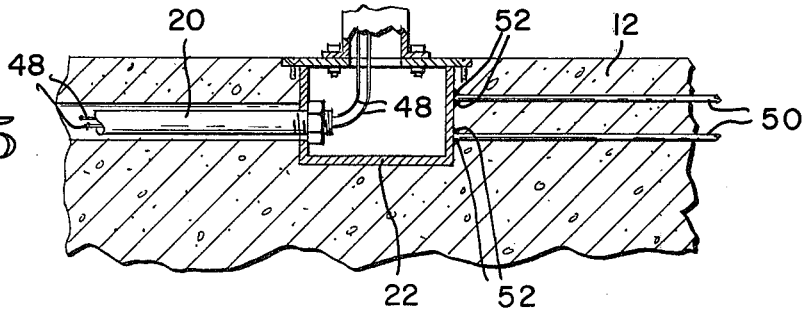
FIG. 5 is a cross-sectional view taken along the line 5—5 of FIG. 1 showing an alternative embodiment of a junction box welded to reinforcing bars embedded in the float.

Each junction box 22 normally receives conduits 20 through both end walls 30. However, the junction boxes 22 at the end of the row of mainwalk floats 12 will be connected to only a single conduit 20 as illustrated in FIG. 5. This single conduit 20 exerts a force on the junction box 22 in the direction from which the conduit extends, but this force is not counteracted by a force from any other conduit 20. In this configuration, it is most desirable to secure reinforcing bars 50 to the opposite end wall of the junction box 12. These reinforcing bars 50 are normally present in the casing surrounding the buoyant core of the float 12 and they may be secured to the end wall 30 by a variety of techniques, such as by welding at 52. The reinforcing bars 50 thus counteract the axial force exerted on the junction box 22 by the conduit 20.

Figure 6:
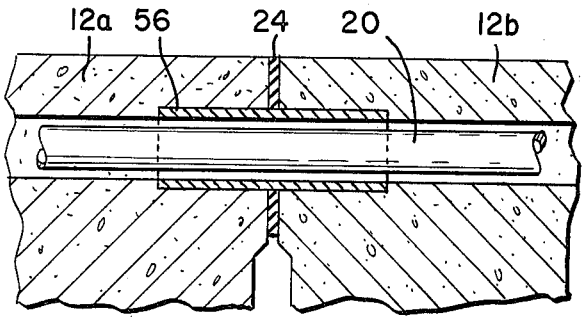
FIG. 6 is a cross-sectional view taken along the line 6—6 of FIG. 1 showing an alternative embodiment utilizing a reinforcing sleeve surrounding the conduit in the area between adjoining floats.

The conduit 20 may be formed of a variety of materials, such as steel or even polyvinyl chloride (PVC). Although some conduit materials, such as steel, provide adequate shear strength in the area between adjoining floats, it is likely that other materials, such as PVC, will not be capable of withstanding shear forces exerted between adjoining floats 12. Accordingly, a reinforcing sleeve 56, as illustrated in FIG. 6, may surround the conduit 20 in the area between the end walls of the floats 12*a,b*. The sleeve 56 may be formed of any suitable material, such as steel. Furthermore, the sleeve 56 may be embedded in one of the floats during fabrication or it may be slipped into respective cavities formed in the end walls of the floats 12*a,b*.

Figure 7:
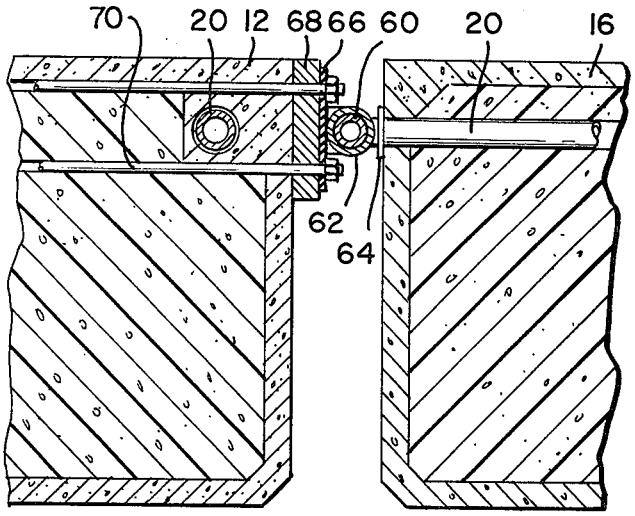
FIG. 7 is a cross-sectional view taken along the line 7—7 of FIG. 1 illustrating a structure for pivotally connecting a finger float to a main-walk float.
Figure 8:
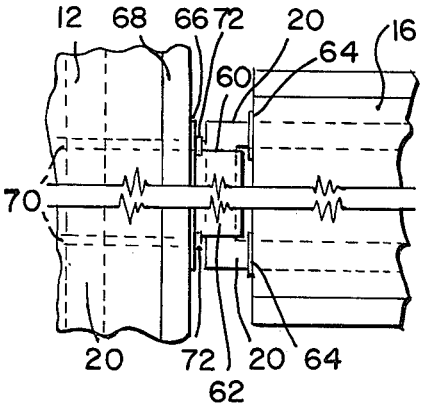
FIG. 8 is a top plan view of the embodiment of FIG. 7.

Returning now to FIG. 1, the finger floats 16 may be secured to the mainwalk floats 12 with a variety of conventional structures. For example, triangularly shaped gussets positioned in each corner between mainwalk floats 12 and finger floats 16 are typically used for this purpose. However, the inventive interconnecting system used for connecting finger floats 16 may be also be used to connect the finger floats 16 to the mainwalk floats 12, as illustrated in FIGS. 7 and 8. Accordingly, a transverse sleeve 60 is secured to the ends of the conduits 20 projecting from the end of the finger float 16, such as by welding. A larger sleeve 62, having a length shorter than the distance between the conduits 20, surrounds the first sleeve 60. The larger sleeve 62 is secured to the side of a mainwalk float 12 in a suitable manner so that the finger float 16 can pivot with respect to the mainwalk float 12 about the longitudinal axes of the sleeves 60, 62. A stop-plate 64 maintains the ends of the conduits 20 a predetermined distance from the end of the finger float 16 to prevent the larger sleeve 62 from contacting the end of the finger float 16.

One structure for securing the larger sleeve 62 to the mainwalk float 12 is illustrated in FIGS. 7 and 8. The sleeve 62 is welded to a backing plate 66 which is secured to the outer face of an elongated wale 68 by a pair of through-rods 70 extending transversely across the mainwalk float 12. The wale 68 and backing plate 66 are secured to the through-rod 70 by nuts 72 threaded onto the ends of the through-rod 70.

The wales 68, which are also illustrated in FIG. 1, may be coterminous with the floats 12, 16. However, they may also extend from one float 12, 16 to another so that they bridge the gap therebetween. Under these circumstances, it is most desirable for the wale 68 to lie in the same horizontal plane as the conduits 20. Otherwise, pivotal movement of the floats 12, 16 with respect to each other unduly tensions or compresses the wale 68 because the conduits 20 act as a neutral bending plane between the floats 12, 16.

Figure 9:
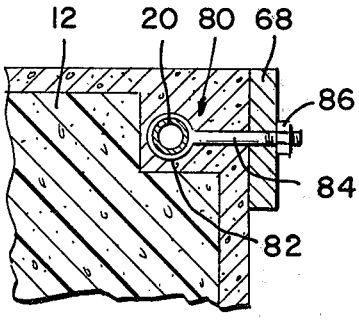
FIG. 9 is a cross-sectional view showing one embodiment for securing an elongated wale along the upper side edge of the floats.

One technique for fastening the wales 68 to the floats 12, 16 in the same horizontal plane as the conduits 20 is illustrated in FIG. 9. In accordance with this technique, a fastening member 80 has an annular eye-portion 82 surrounding the conduit and a shank portion 84 projecting outwardly through the floats 12, 16 through the wale 68. A nut 86 is then threaded onto the end of the shank 84.

The inventive interconnecting system thus provides both mechanical and electrical interconnections between mainwalk floats and finger floats in a manner which facilitates routing of utility conductors to utility outlets while allowing adequate relative movement between adjoining floats. It furthermore allows the finger floats 16 to be pivotally connected to the mainwalk floats 12, and it is sufficiently flexible to allow elongated wales to be mounted along the upper sidewalls of the floats with a variety of structures.

I claim:

1. A system for interconnecting first and second marine floats end-wall-to-end-wall, comprising:

a sheet of cushioning material positioned between adjacent end walls of said first and second floats;

a tubular conduit extending between said first and second floats through said cushioning material;

first and second junction boxes embedded, respectively, in said first and second floats, said junction boxes receiving respective ends of said conduit;

fastening mens for resiliently securing the respective ends of said conduit to said first and second junction boxes to allow said conduit to move axially and pivot with respect to said junction boxes responsive to relative pivotal movement between said first and second floats; and a utility conductor extending through said conduit between said junction boxes whereby said conduits provide both mechanical and utility interconnections between said first and second floats.

2. The interconnecting system of claim 1, wherein said fastening means includes a resilient pad covering one wall of said junction box through which said conduit extends and a threaded fastener mounted on the ends of said conduit which is torqued against said resilient cushion and end wall whereby pivotal movement between said first and second floats compresses said resilient cushion to allow said conduit to move axially and pivot with respect to said junction boxes.

3. The interconnecting system of claim 1, further including a utility outlet mounted on at least one of said junction boxes, said utility outlet being connected to the utlity conductors entering said junction box through said conduit.

4. The interconnecting system of claim 1, further including a plurality of reinforcing bars embedded in said float, at least some of said reinforcing bars being secured to said junction box to anchor said junction box in said float.

5. The interconnecting system of claim 1, further including a tubular reinforcing sleeve extending between said first and second floats and surrounding said conduit to protect said conduit against excessive shear forces generated between said floats.

6. The interconnecting system of claim 1, further including a pair of wales extending between said first and second floats along opposite sides thereof, said wales being positioned in the same horizontal plane as said conduits to minimize the axial forces imparted to said wales responsive to pivotal movement between said first and second floats.

7. The interconnecting system of claim 6, wherein said wales are secured to said floats by inserts which are secured to the adjacent conduits and which project laterally through said wales.

8. The interconnecting system of claim 7, wherein said insert includes an annular ring extending around said conduit and a shank projecting from said ring outwardly through said wales.

* * * * *